US005746399A

United States Patent [19]

Ehrlich et al.

[11] Patent Number: 5,746,399

[45] Date of Patent: May 5, 1998

[54] CAR SPACE MEASUREMENT APPARATUS

[75] Inventors: Kenneth P. Ehrlich, Pittsburgh; David Kutz, Greensburg; Edmund C. Nowakowski, Pittsburgh, all of Pa.

[73] Assignee: Union Switch & Signal Inc., Pittsburgh, Pa.

[21] Appl. No.: 632,941

[22] Filed: Apr. 16, 1996

Related U.S. Application Data

[60] Provisional application No. 60/001,353, Jul. 21, 1995.

[51] Int. Cl.[6] ..... B61L 25/02

[52] U.S. Cl. ..... 246/122 R; 246/167 R

[58] Field of Search ..... 246/3, 2 E, 25, 246/122 R, 167 R, 167 D, 177, 178; 364/424.01, 424.02

[56] References Cited

U.S. PATENT DOCUMENTS

| | | | |
|---|---|---|---|
| 1,924,491 | 8/1933 | Gibbs | 104/26 |
| 2,454,687 | 11/1948 | Baughman | 177/352 |
| 3,601,602 | 8/1971 | Smith | 246/124 |
| 3,619,604 | 11/1971 | Auer, Jr. et al. | 246/122 R |
| 3,740,549 | 6/1973 | Thorne-Booth | 246/122 |
| 3,757,112 | 9/1973 | Lehmann | 246/122 R |
| 3,817,344 | 6/1974 | Asano et al. | 180/98 |
| 3,821,544 | 6/1974 | Matty | 246/34 CT |
| 3,836,770 | 9/1974 | Helmcke | 246/167 D |
| 3,877,666 | 4/1975 | Itakura et al. | 246/122 R |
| 3,902,689 | 9/1975 | Hermann et al. | 246/63 C |
| 4,352,524 | 10/1982 | Krug | 246/122 R |
| 5,060,890 | 10/1991 | Utterback et al. | 246/169 A |
| 5,364,047 | 11/1994 | Petit et al. | 246/122 R |
| 5,398,894 | 3/1995 | Pascoe | 246/122 R |
| 5,417,388 | 5/1995 | Stillwell | 246/122 R |
| 5,533,695 | 7/1996 | Heggestad et al. | 246/122 R |

*Primary Examiner*—S. Joseph Morano
*Attorney, Agent, or Firm*—Kevin A. Sembrat

[57] ABSTRACT

A car space measurement apparatus for tracking a rail vehicle position on a track is provided, which includes a wayside sensor and a supervisory processor. The wayside sensor senses multiple track parameters that are representative of the rail vehicle position. The supervisory processor receives selected track parameters and determines the rail vehicle position therefrom. Also the supervisory processor asynchronously displays a track position indication representative of the rail vehicle position. The apparatus can have an operational mode, a calibration mode, and a self -test mode. The selected track parameters are analog track phase signals. The supervisory processor can include an analog signal processor, a phase processor for determining the track position indication and a control processor for asynchronously receiving and displaying the track position indication. The asynchronous interface can be a asynchronous computer bus interface.

44 Claims, 8 Drawing Sheets

CAR SPACE MEASUREMENT APPARATUS

CROSS REFERENCE TO RELATED APPLICATION

This application claims the benefit of U.S. Provisional Application No. 60/001,353, filed Jul. 21, 1995, which is hereby incorporated by reference in its entirety.

BACKGROUND OF THE INVENTION

1. Field of the Invention

The invention herein relates to a position monitoring apparatus, in particular to rail vehicle position monitoring apparatus and, more particularly, to rail vehicle position monitoring apparatus measuring track shunt distance with respect to a specified point along a length of track.

2. Description of the Related Art

In general, the car space measurement establishes the distance on a track from a given reference point, usually a clearance point, to the point of the last standing shunt as produced by the last rail vehicle on that track. This distance can be referred to as distance-to-go, or DTG. The car space measurement can be determined by defining the electrical phase relationship between a reference signal and a measurement signal reflected from the rails of the track, as modified by the shunt. An AC measurement signal applied to a track typically encounters an impedance which includes this phase relationship and which is composed of resistive and inductive components. This measurement signal, for example, the track current, can lag in time when compared with the reference signal, for example, the system voltage, with the lag being proportional to the track impedance. The inductive reactance of the track typically increases with shunt distance, so that the shunt produced by the last standing car can delimit how much inductive reactance is offered by the track. When a track is full, the inductive reactance can be very low, and the phase shift between the track current and the system voltage can be very close to zero degrees. Similarly, when the track is empty, the inductive reactance in the circuit tends to be large and the track current phase can lag the system voltage phase by an appreciable amount.

Many car space measurement devices employ analog components, both to sense desired track parameters, such as track current phase, and to analyze measured track current phase to determine rail vehicle position. Typically, analog track current phase measurement uses differential signal inputs for each of the monitored tracks. Where eight tracks are monitored, differential inputs can call for the manipulation of at least sixteen different signals plus additional inputs for reference signals. In addition, each signal input pair can be associated with a separate analog signal processing board; such boards often include subsystems such as analog gain, offset, and calibration circuitry, signal averaging circuits, power regulators, and the like. Thus, each analog board tends to be bulky, can be susceptible to signal drift and decreased noise immunity, and can be difficult to fabricate and maintain. Because analog averaging circuits can contain numerous operational amplifiers and filters, the response of such circuits can substantially lag the actual zero-crossing event, potentially reducing the accuracy of the rail vehicle position measurement.

Currently, calibration of a track position monitoring apparatus can require a first human operator to place a shunt at a reference point on a track while a second human operator manually calibrates each of the analog components associated with the respective track. Calibration of analog circuits can require the use of high-precision test instruments such as oscilloscopes, multimeters, and the like, which can encumber the second operator and make calibration a slow and difficult process. When the reference point is ascertained, the first operator then places the shunt at a preselected distance from the reference point, typically 1000 feet. Again, the second operator manually calibrates each of the analog components relative to the 1000 foot point. This method of calibration can be very labor intensive and can require skilled technicians to calibrate the analog boards. Also, the range of shunt distances over which the analog phase processor can be calibrated accurately is limited. In general, track impedance is approximately linearly related to length of the shunt between zero and 1000 feet. However, at greater distances the track impedance/shunt distance relationship is substantially non-linear, and current analog detection and measurement devices may not be capable of compensating for the non-linearity imposed by greater shunt distances.

What is needed then is a car space or rail vehicle position monitoring apparatus that can require fewer signal inputs, can increase position indication accuracy, and can be simpler to fabricate, calibrate, and maintain.

SUMMARY OF THE INVENTION

The invention provides a car space measurement apparatus for tracking a rail vehicle position on a track, which includes a wayside sensor and a supervisory processor. The wayside sensor senses multiple track parameters that are representative of the rail vehicle position. The supervisory processor receives selected track parameters and determines the rail vehicle position therefrom. Also the supervisory processor asynchronously displays a track position indication representative of the rail vehicle position. The apparatus can have an operational mode, a calibration mode, and a self-test mode.

The selected track parameters can be analog track phase signals. The supervisory processor can include an analog signal processor for receiving the analog signals; a phase processor for determining the rail vehicle position from the track phase signals and generating the track position indication; and a control processor for selectively, and substantially asynchronously, receiving and displaying the track position indication.

The analog signal processor can include a signal conditioner with filter having a preselected cutoff frequency; an analog signal converter for converting the analog sinusoidals into digital signals; and an opto-isolator for reducing electromagnetic interference with the digital signals. Furthermore, the phase processor can include a track selector for selectively receiving digital signals representative of the rail vehicle position on the track; a digital phase analyzer for receiving the digital signals and extracting the track position indication therefrom; and an asynchronous interface for asynchronously providing the track position indication to the control processor. The signal conditioner filter can be a high-pass filter, with a cutoff frequency of about 30 Hz. The asynchronous interface can be a asynchronous computer bus interface, such as an STD bus interface. In general, the track phase signals can include the compensated track impedance phase angle and can have a variable phase delay responsive to the rail vehicle position on the track, and the analog signal converter provides a serial digital pulse stream that is representative of the phase delay.

An advantage of the present invention is that cost of producing the present invention is reduced by as much as 30% of the cost of producing existing analog measurement based systems.

Another advantage of the present invention is that a resolution potential of+/−0.33 feet is provided for making instantaneous velocity measurements, compared to the+/− three feet maximum resolution provided by the related art.

Another advantage of the present invention is that its compactness provides portability not readily available with related art systems which require a rack measuring as much as 70 inches (178 cm) across in length.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENTS

Figure 1:
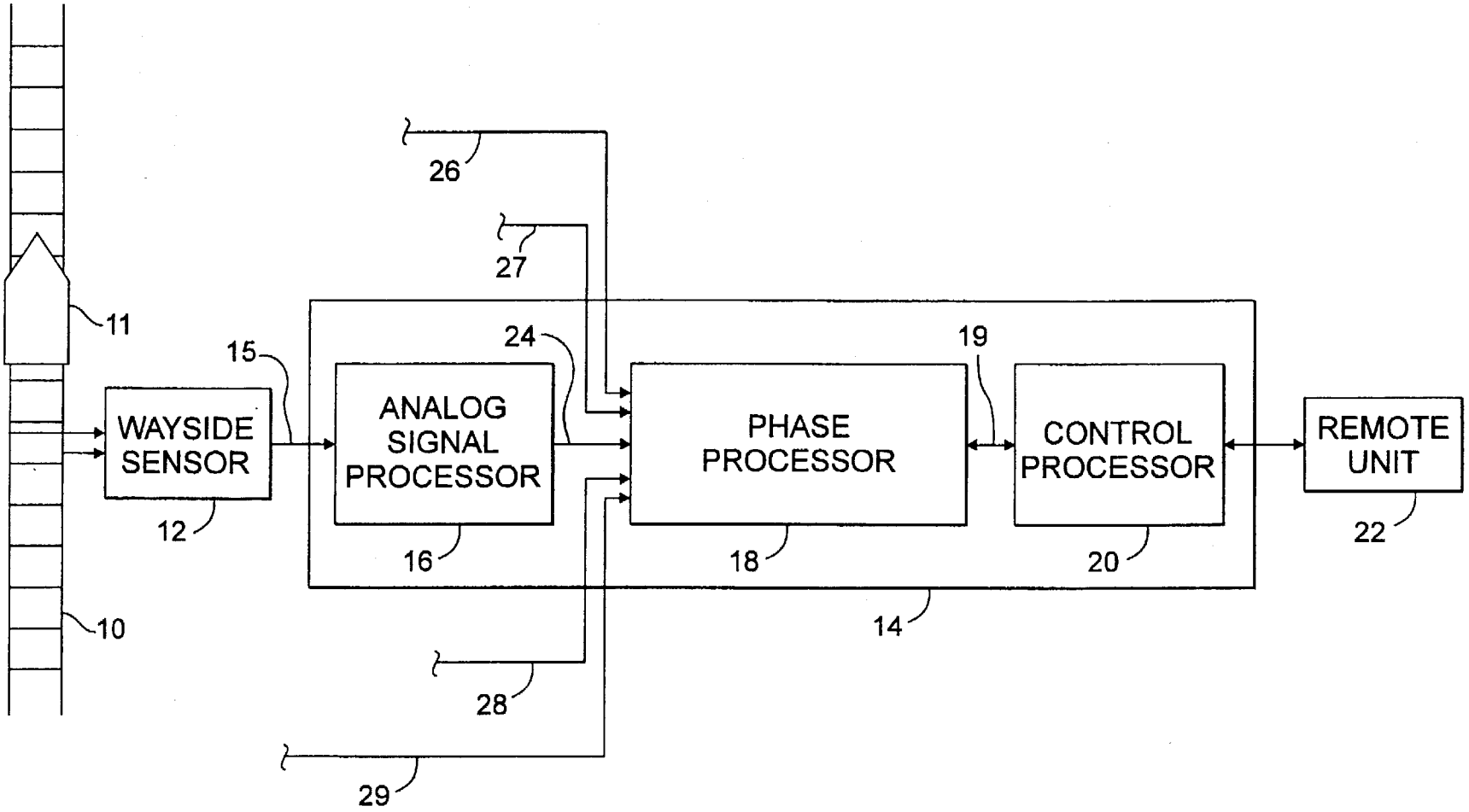
FIG. 1 is a diagrammatic representation of one embodiment of a track position monitoring apparatus according to the present invention.

The invention herein provides an apparatus for monitoring rail vehicle position on a track wherein a car space measurement is determined and displayed. As seen in FIG. 1, wayside sensor 12 can be operably connected to a track 10 for sensing a plurality of track parameters, such as track signals, that are reflective of the position of a rail vehicle 11. The apparatus can also include a supervisory processor 14 that receives selected parameters 15 from the wayside sensor 12. In general, processor 14 can be configured to be compatible with existing sensors 12. Processor 14 can determine rail vehicle position from selected parameters 15, extract a track position indication therefrom, and asynchronously display the track position indication. Because parameters 15 from sensor 12 are typically analog in nature, processor 14 can have analog signal processor 16, for receiving and processing the track phase signals.

A phase processor 18 can receive signals representative of the rail vehicle position from sensor 12, extract a track position indication therefrom, and asynchronously communicate the track position indication to a control processor 20 via an asynchronous bus 19. In addition to a track phase signal 24 from track 10, phase processor 18 can also receive track phase signals 26, 27, 28, from other tracks (not shown) such that control processor 20 can monitor, essentially simultaneously, the track position indication of vehicles on multiple tracks. For clarity, only four tracks are represented by signals 24, 26, 27, 28. However, phase processor 18 can receive signals from more than four tracks, for example, a group of eight tracks, which may be successive tracks. Accordingly, control processor 20 can selectively receive and display track position indications which are received from phase processors, including processor 18. A reference signal 29 similarly can be generated for comparison with track phase signals 24, 26, 27, 28. Supervisory processor 14 may also include a remote unit 22 which can be a simple terminal or workstation, or may be a remote operations unit.

Figure 2:
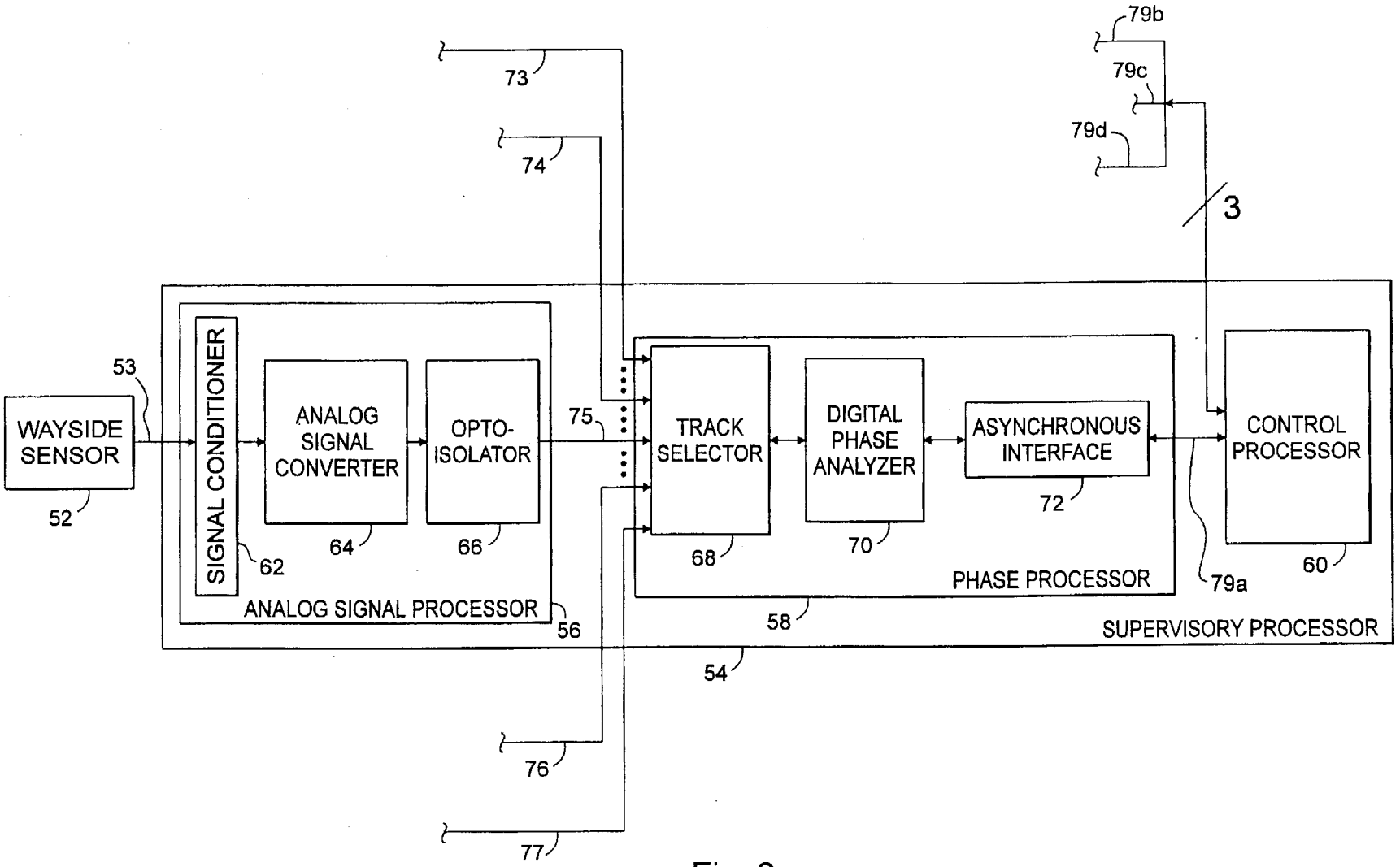
FIG. 2 is a diagrammatic representation of another embodiment of a track monitoring apparatus.

FIG. 2 illustrates one embodiment of a supervisory processor 54 including an analog signal processor 56, a phase processor 58, and a control processor 60. As with the wayside sensor 12 in FIG. 1, a wayside sensor 52 can receive input signals 53 that are representative of rail vehicle position. Because high frequency noise can create spurious track position indication, a signal conditioner 62 may be provided. It is desirable to digitally analyze the track phase signal, and an analog signal converter 64 is included. The converter 64 can produce a serial digital pulse stream which is representative of the zero-phase crossings of input signals 53.

Furthermore, where it is desired to reduce electromagnetic interference with processor output 75 and to electrically separate the analog circuitry in the processor 56 from the digital circuitry in the processor 58, an opto-isolator 66 can be used. A processor output 75 can be received by a track selector 68 in a phase processor 58. The track selector 68 can permit a control processor 60 to monitor rail vehicle positions on multiple tracks as reflected in the respective sensor output signals 73, 74, 75, and 76. For clarity, only four tracks are represented by signals 73, 74, 75, 76. However, the track selector 68 can receive signals from the seniors associated with more than four tracks, for example, a group of eight tracks, which may be successive tracks. The selected sensor output, such as signal 75, can be directed to a digital phase analyzer 70 wherein a track position indication is extracted from the track phase signal 75 by comparison with a voltage reference signal 77. An asynchronous interface 72 can be used to permit control processor 60 to selectively receive a track position indication signal 79*a* from phase processor 58 or track position indication signals 79*b*, 79*c*, and 79*d* from other phase processors which also can be connected to the control processor 60.

Figure 3A:
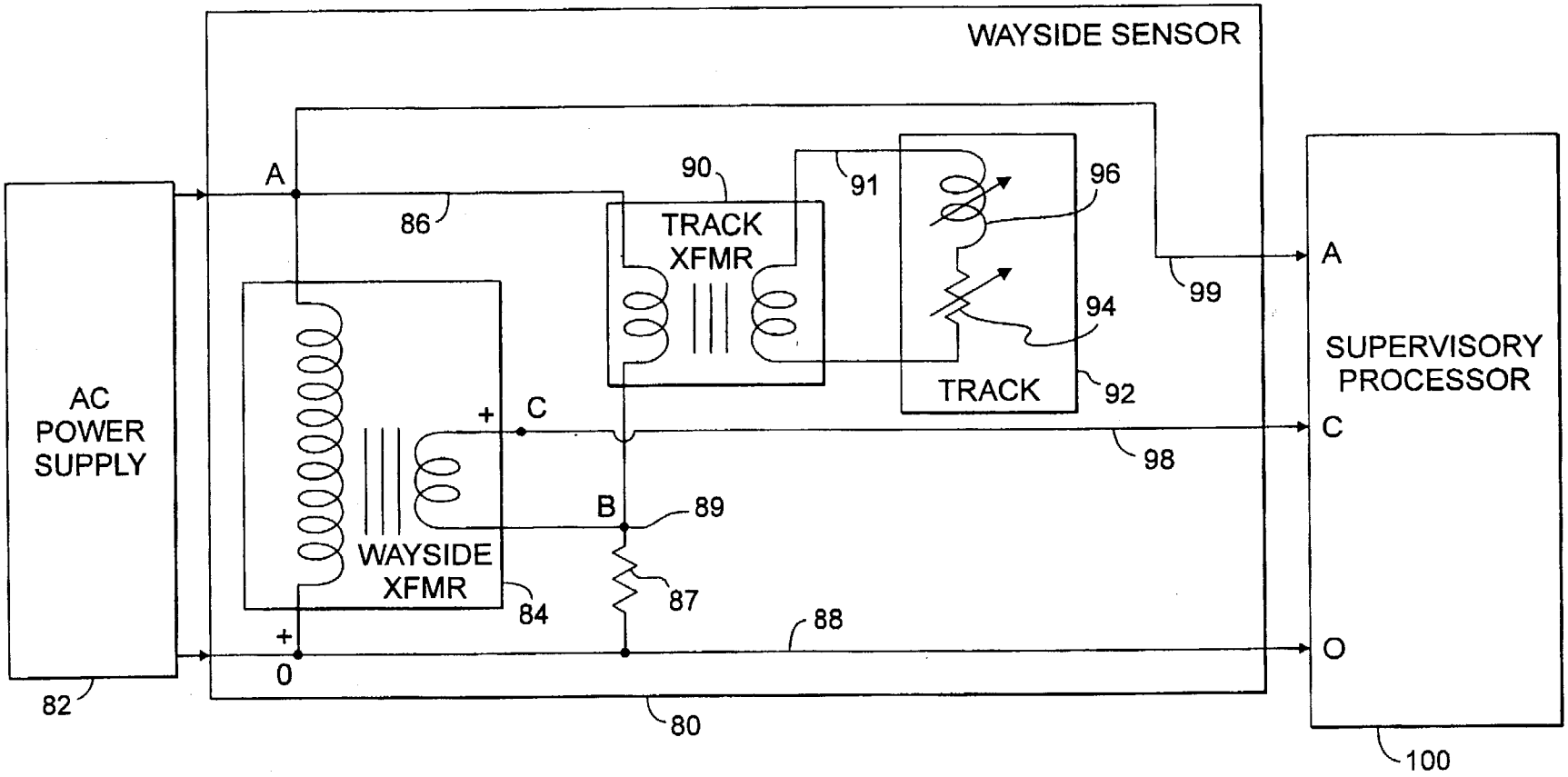
FIG. 3*a* is a schematic diagram of one embodiment of a wayside sensor according to the present invention.

FIG. 3*a* illustrates one embodiment of a wayside sensor 80 which can be used to sense track parameters representative of rail vehicle position. In general, the sensor 80 can receive AC power from a power supply 82. It is preferred that the AC power for the sensor 80 be 60 Hz AC power. The power from power supply 82 may also be used to provide a reference signal. The sensor 80 can include a wayside transformer 84 and a track transformer 90. The track transformer 90 can be used to supply a measurement signal, which can be a track current 91, to the desired track, which track can be represented as an impedance 92. The impedance 92 is typically composed of variable resistance 94 and variable inductance 96, which vary with the vehicle's position on the track. Due to inductance 96, the phase of the track voltage tends to lag the system voltage supplied by the power supply 82. System voltage can be referred to as voltage EOA, i.e., the voltage between labeled points A and O on the sensor 80. According to Kirchoff's voltage law, the line voltage EOA is essentially equal to the sum of the voltage drops across the track transformer 90, which can be referred to as voltage EBA, and wayside resistance 87 to ground signal 88, which can be referred to as voltage EOB.

A supervisory processor 100 can receive two track phase signals 98 and 88, the potential difference between which can be represented by voltage EOC, from which the track phase relative to a reference voltage signal 99 may be determined. The processor 100 also may receive the signal 99, which is reflective of system voltage EOA. This signal can be employed as a reference signal upon which the relative measurements are based. It is preferred that track phase detection employ voltage EOC, i.e., signals 98 and 88, that corresponds to each individual track.

Figure 3B:
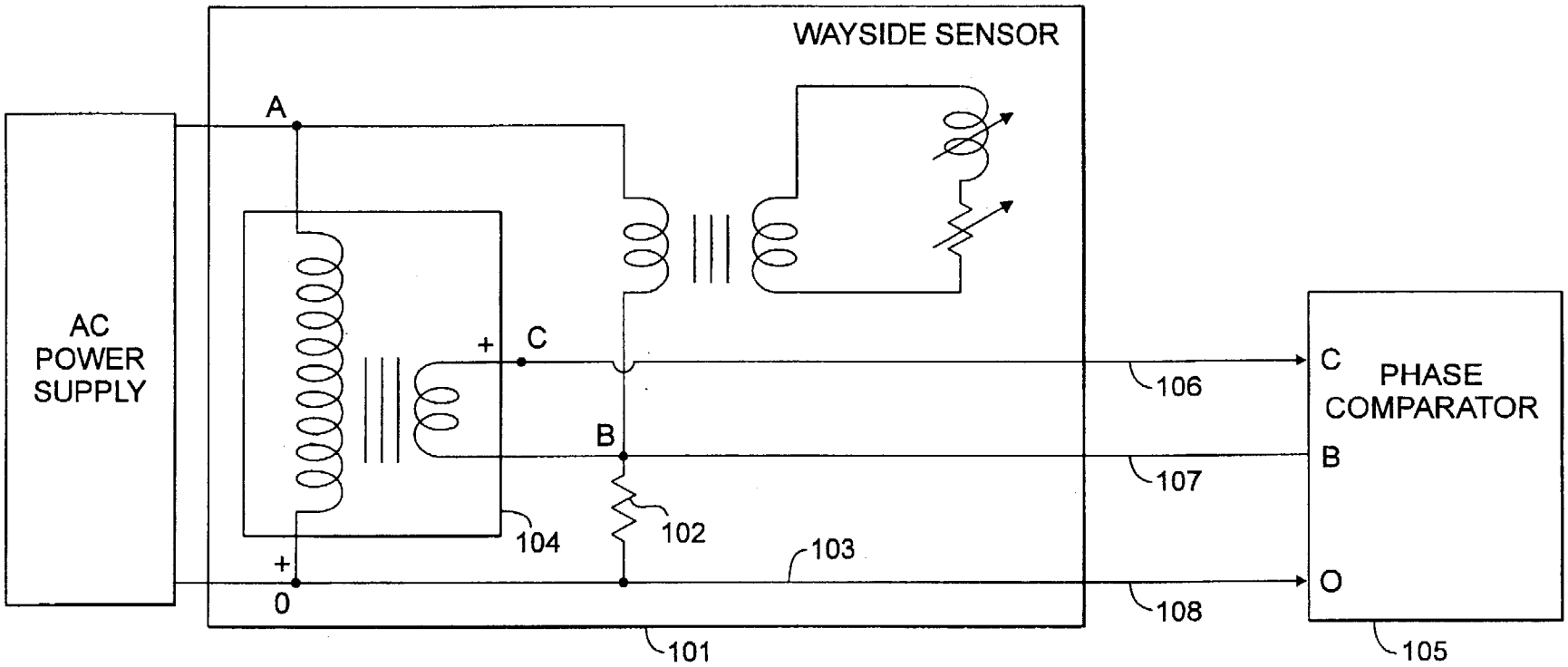
FIG. 3*b* is a schematic diagram of a current wayside sensor.

FIG. 3*b* illustrates a wayside sensor 101 that is configured to be used with current track phase processing techniques. Current track phase processing analyzes the voltage drops across a wayside resistance 102 to a ground signal 103, i.e., voltage EOB, and across a wayside transformer 104 to the ground signal 103, i.e., voltage EOC, to obtain voltage EBC, using voltage EOC as the reference signal. Voltage EOA is not measured directly. In general, voltage EBC has a phase relationship with voltage EOC that is generally linear with shunt distance. A disadvantage of using voltage EBC to measure shunt distance is the need for sensing and processing a pair of track-associated signals, i.e., voltages EOB and EOC, for each monitored track. Also, current processing techniques use a reference signal, i.e., voltage EOC, that is relative to the track. In the track monitoring apparatus according to the invention herein seen in FIG. 3*a*, only one track-associated signal, namely signal 98, or voltage EOC, is used to determine the track phase in each processor 100. Reference signal 99, i.e., voltage EOA, can be used to extract the actual track phase value. Because voltage EOA expresses the system supply voltage, voltage EOA can provide a system-wide reference signal.

Figure 4B:
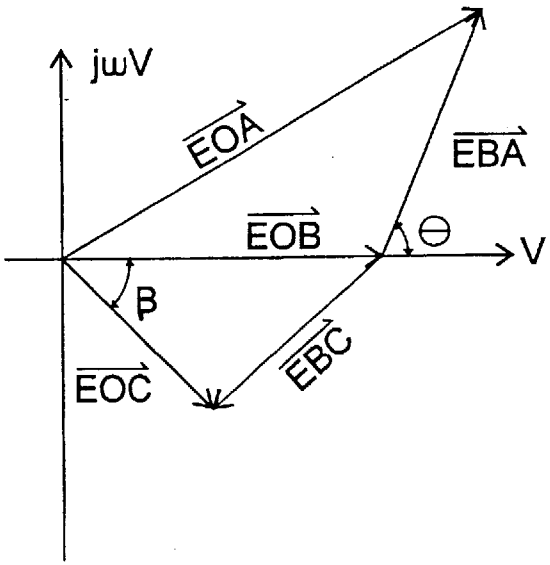
FIG. 4*b* is a vector diagram illustrating the parameters sensed by current monitoring apparatus.
Figure 4A:
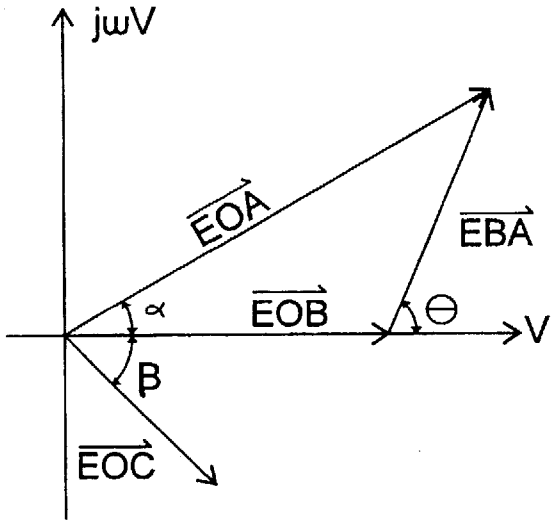
FIG. 4*a* is a vector diagram illustrating the parameters sensed by the apparatus according to the present invention.

FIGS. 4*a* and 4*b* represent the vector relationships used in the invention herein and in current track monitoring, respectively. In FIGS. 4*a* and 4*b*, the horizontal axes represents real-valued voltage components, i.e., pure resistance, and the vertical axes represent imaginary-valued voltage components, i.e., pure reactance.

In FIG. 4*a*, which corresponds to the configuration in FIG. 3*a*, voltages EOA and EOC are represented as vectors EOA and EOC, respectively. Vector EOA, which represents input from the power supply, has both real and reactive components. As indicated above, using Kirchoff's voltage law on FIG. 3*a*, vector EOA is seen to be a vectorial sum of vectors EOB and EBA. Vector EBA is a measure of the reflected impedance through the track transformer, such as transformer 90 in FIG. 3*a* as a function of shunt distance. Uncompensated track impedance phase angle $\theta$ varies proportionately with vector EBA. When angles $\beta$ and $\alpha$ are summed, the resultant phase angle $\gamma$ also is proportionally related to shunt distance. However, unlike the measurement of uncompensated track impedance phase angle $\theta$ alone, as is performed in many existing car space measurement devices, the measurement of the compensated track impedance phase angle ($\beta+\alpha$), as employed in the invention herein, can be less sensitive to environmental factors which can affect vector EBA. This is because, as vector EBA tends to increase (decrease) with changes in the environment, vector EOB tends to decrease (increase), such that vector EOA, and hence vector EOC and phase angle $\beta$, tend to remain constant. Also, phase angle $\alpha$ tends to remain constant, primarily due to the inertia of the 120 VAC power source. Therefore, the compensated track impedance phase angle $\gamma$ can become less sensitive to changes in the real component of vector EBA, which is reflective of changes in the environment.

In FIG. 4*b*, which corresponds to the currently-used configuration in FIG. 3*b*, vector EOB represents the voltage across wayside resistance 102. Because voltage EOC develops across the secondary of the 2:1 wayside transformer 104, and the polarity of transformer 104 is inverted at its output, vector EOC contains a negative reactive component, indicating that the voltage at point C at wayside transformer 104 tends to lag voltage EOB. Vector EOC represents the vectorial difference between vectors EOB and EBC. Accordingly, the magnitude of vector EBC is approximately one-half the magnitude of vector EOA but generally opposite in direction. Unlike processor 100 in FIG. 3*a* which requires only two input signals, namely, signal C, 98, and signal O, 88, and one comparator to produce the value of Vector EOC, phase comparator 105 in FIG. 3*b* uses three input signals, namely signal C, 106, signal B, 107, and signal O, 108, and two internal comparators to produce the value of vector EBC.

Figure 5:
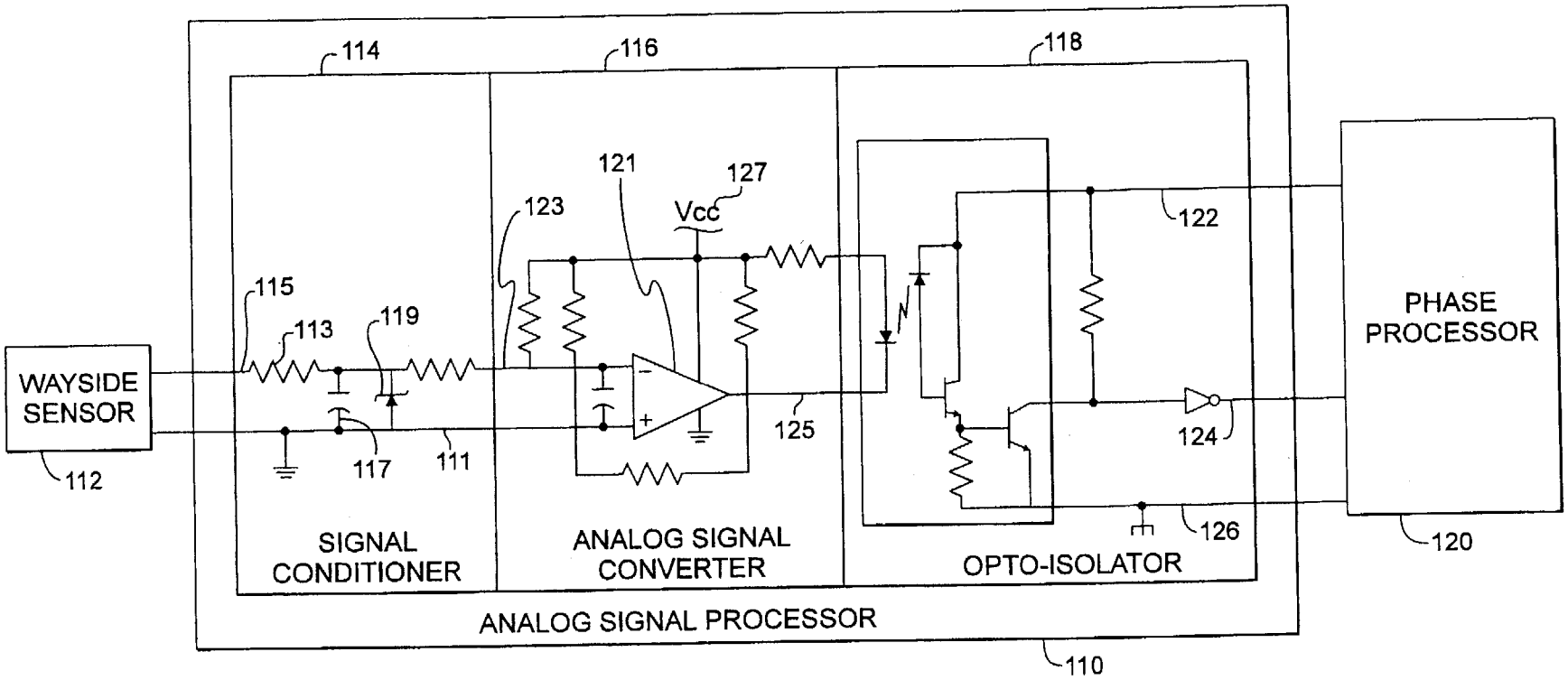
FIG. 5 is a schematic diagram of one embodiment of an analog sensor.

FIG. 5 illustrates one embodiment of analog signal processor 110. Similar to FIG. 3*a*, a wayside sensor 112 in FIG. 5 can provide a track phase signal 115 to a signal conditioner 114, with the potential difference between the signal 115 and a ground signal 111 being voltage EOC. Where the signal 115 is connected to system voltage, the potential difference between signals 115 and 111 can be voltage EOA, the reference signal. The signal conditioner 114 is preferred to include a low-pass RC filter using a resistance 113 and a capacitance 117, the values of which can be chosen to attenuate preselected frequencies in the analog track phase signal 115. A preselected cutoff frequency, for example, about 30 Hz, can be chosen to permit a usable amount of the signal 115 at 60 Hz to pass through the filter to an analog signal converter 116, while sufficiently attenuating high-frequency noise. In addition, a diode 119 can be provided to limit signal amplitudes such that other components of the sensor can be protected therefrom.

After the signal 115 has been filtered and clipped, it can be delivered to the analog signal converter 116 for conversion into a generally square waveform that can be symmetrical about zero volts. In general, the converter 116 is responsive to a variable phase delay which can correspond to the distance-to-go on the associated track. The converter 116 can produce a serial digital pulse stream that is representative of such phase delay. A comparator 121 in converter 116 can be a high-gain, high bandwidth comparator that serves as a zero-crossing detector. As an input signal 123 passes through zero volts, an output signal 125 of the comparator 121 can change state to indicate that the signal 123 is above or below a reference signal level. A symmetrical sinusoidal input signal to the comparator 121 can thereby be converted to a square wave. For example, as input signal 123 increases through zero volts towards a positive peak value, the comparator output 125 can be shorted to ground; as the input signal 123 decreases through zero towards its negative peak value, the comparator output 125 can be pulled up to the value of Vcc 127, for example, 5 volts DC. A comparator such as the LM239A, manufactured by Texas Instruments, Inc., Dallas, Tex., can be used. Where the input signal 115 to the comparator 121 is system voltage EOA, a converter output signal 124 can be a reference serial pulse stream representative of the zero-phase state. Similarly, where input signal 115 to comparator 121 is track signal voltage EOC, the converter output 124 can be a serial digital pulse stream that is representative of the track phase delay for the associated track.

To provide the desired electrical isolation between the analog circuitry and the digital circuitry, an opto-isolator 126 can be used. In one embodiment, it is preferred that an HCPL5700 optical isolator, manufactured by Hewlett Packard Corp., Palo Alto, Calif., be used. The opto-isolator 118 can substantially reduce the coupling of noise between the output signal 125 and the output signal 124. A digital power signal 122, which is preferred to be 5 volts, can be supplied by a phase processor 120 to further enhance noise isolation.

Figure 6:
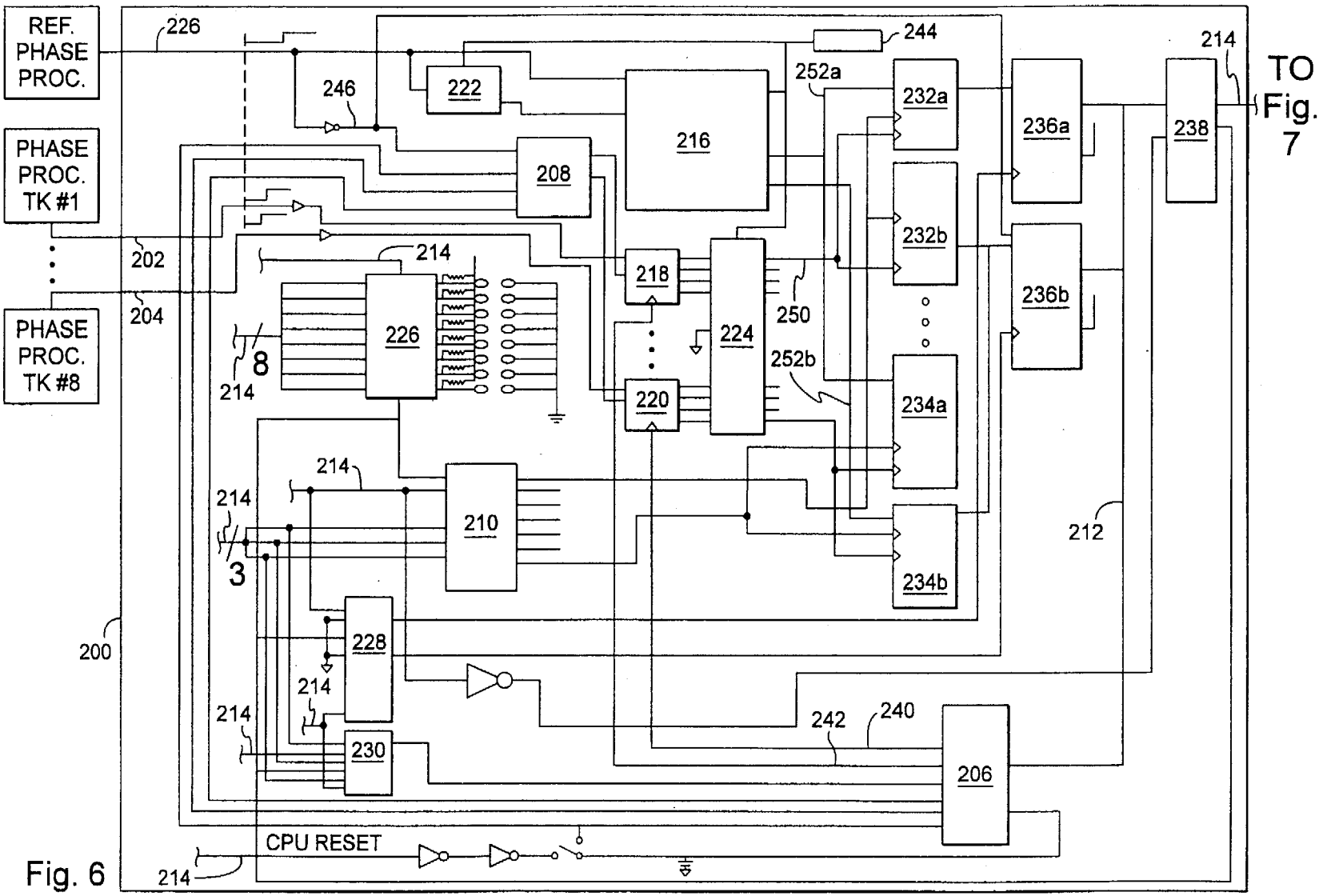
FIG. 6 is a schematic diagram of one embodiment of a phase processor.

FIG. 6 illustrates one embodiment of a phase processor 200. Track phase signals 202, 204 can be received from respective analog signal processors, such as the processor 56 in FIG. 2, and can represent the measured signal inputs from tracks #1 and #8, respectively. In general, each of signals 202, 204 can correspond to the signal 124 in FIG. 5 from the respective analog signal processor 110. For clarity, only two phase signals 202, 204 are represented; in addition, digital phase analysis will be described only in terms of track #1. The phase processor 200 can receive more signals, for example, eight (8) track phase signals, as indicated in FIG. 2. The processor 200 in FIG. 6 can have a track selector to permit selective processing of the signals 202, 204. In FIG. 6, track selection is accomplished using a latch 206, a multiplexer 208, and an address decoder 210, according to the input on a data bus 212 from an asynchronous bus 214. The asynchronous bus 214 can receive track selection information from the controller processor and is similar to the asynchronous bus 19 in FIG. 1. Once a particular one of track signals 202, 204 has been selected, a digital phase analyzer, such as analyzer 70 in FIG. 2, can be used to extract track position indication therefrom, and to transmit the track position indication to the control processor for additional analysis and display. Digital phase analysis can be performed using a counter 216, encoders 218, 220, pulse generator circuitry 222, an oscillator 244, a signal latch 224 and track data latches 232*a*, 232*b* and 234*a*, 234*b*.

In one embodiment of the processor 200, the oscillator 244 can be a crystal oscillator having a oscillation frequency of 1.0 MHz. Also, the counter 216 can be two 12-bit counters which are cascaded together and of which only 15 bits may be used. A leading edge on a reference signal 226 can trigger the counter 216 to count upward. Counter outputs 252*a*, 252*b* are received by the track data latches 232*a*, 232*b* so that latches 232*a*, 232*b* contain the current value of the counter therein. When a leading edge of the signal 202 from track #1 is received by the encoder 218, it is passed to the latch 224, and retained therein, until the latch 224 is enabled by the oscillator 244. When so enabled, the latch 224 asserts an output 250, thereby strobing the latches 232*a*, 232*b* and causing the latches 232*a*, 232*b* to "capture" the value in the counter 216 at the time of strobing. Counting can be disabled on a falling edge of the reference signal 226, and the counter 216 can be reset. The value in the latches 232*a*, 232*b* generally represents the time differential and, hence, the phase lag between the reference signal 226 and track #1 phase signal 202, and thus can be representative of a track position indication. Where the oscillator 244 has a 1.0 MHz oscillation frequency, each count from the counter 216 can have a time value of about 1 microsecond. As an example, a total count in the latches 232*a*, 232*b* having a value of 1,250 can represent a delay of about 1.250 milliseconds, which itself could be representative of a track shunt distance of about 850 feet.

When a track position indication has been extracted from selected track phase signals 202, it is latched into respective output buffers 236*a*, 236*b*. The buffers 236*a*, 236*b* retain track position indication data in low byte-high byte order, respectively, until the control processor requests the data via the bus 214. Upon such request, the bus transceiver 238 selectively passes data from the selected one of the buffers 236*a*, 236*b* to be placed onto the bus 214. In the embodiment of the phase processor 200, bus 214 is an 8-bit bus, requiring two read cycles to effect transfer of data that is nine or more bits wide. Because buffers 236*a*, 236*b* can be tristate buffers, the buffer that is not selected will remain in a high-impedance state, thereby avoiding contention with the selected buffer. In general, the asynchronous bus interface, such as the interface 72 in FIG. 2, can include the buffers 236*a*, 236*b* and the transceiver 238.

Phase processor 200 can also have the ability to perform built-in self-testing in the built-in test (BIT) mode. The control processor can direct transceiver 238 to receive data on the bus 212. Next, the control processor can place an address corresponding to a particular track onto the bus 214 where the address is input to decoder 210. In addition, encoder 208 can be enabled to provide a test signal 246, which can be an inverted version of the reference signal 226, to the multiplexers 218, 220. The control processor can also de-select signals 202, 204 as inputs to the multiplexers 218, 220, by way of the appropriate selection signal 240, 242 from latch 206. When the reference signal 226 is received, the counter 216 begins to count upward, as clocked by the oscillator 244. Simultaneously, counter data is input to the corresponding track data latch, such as pair 232*a*, 232*b* or 234*a*, 234*b*. When the rising edge of test signal 246 is encountered, the current value in counter 216 can be latched into the appropriate track data latch pair 232*a*, 232*b* or 234*a*, 234*b*. With an oscillator frequency of 1.0 MHz, the latched counter value would be approximately 8500, which corresponds to a time delay of about 8.5 milliseconds. This is about one-half of the period of a 60 Hz signal. The test value can subsequently be latched into buffers 236*a*, 236*b* and transmitted through transceiver 238 onto bus 214 and back to the central processor for analysis. In this way, the circuitry associated with each track, and with each phase processor, can be evaluated.

Figure 7:
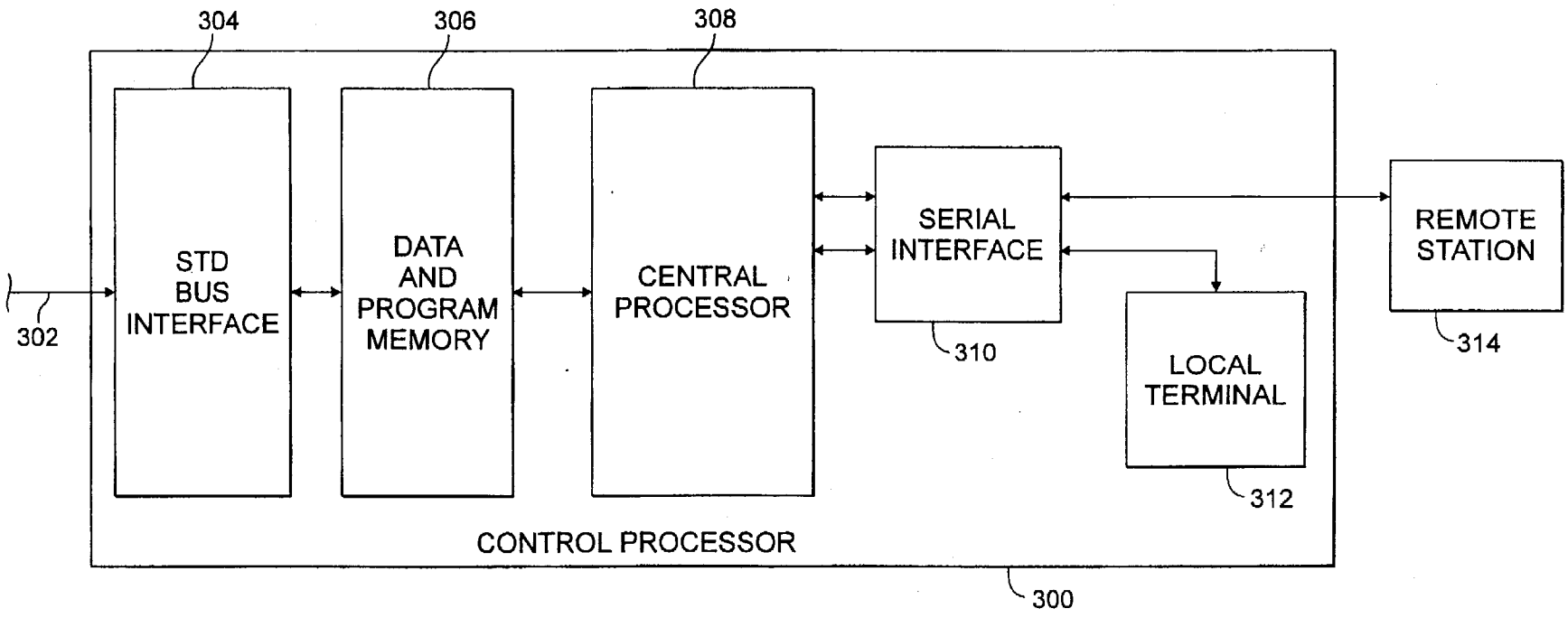
FIG. 7 is a diagrammatic representation of one embodiment of a control processor.

FIG. 7 illustrates one embodiment of a control processor 300. The processor 300 can receive the selected track position indication from a phase processor, such as the phase processor 200 in FIG. 6, via the asynchronous bus 214. As indicated in FIG. 2, the control processor 300 can receive information from, and transmit commands to, a plurality of phase processors which may be connected to the processor 300 via common bus 214, or may be connected to the processor 300 using a separate bus interface 304 for each group of tracks to be monitored. In the embodiment exemplified by the control processor 300, a bus 302 is an asynchronous computer bus, such as an STD bus. The bus interface 304 bidirectionally formats data so that data received from the bus 214 is compatible with the native bus protocol of processor 300 and data transmitted to the bus 214 observes the desired bus protocol, for example, the STD bus protocol. A memory 306 can provide temporary storage for received and transmitted data, as well as for storage of operational data and program instructions for a central processor 308. The central processor 308 can be a LPM-486SLC microprocessor-based system, manufactured by Winsystems, Inc., Arlington, Tex. The LPM-486SLC can have a central processing unit based upon a 80486 microprocessor by Intel Corp., Santa Clara, Calif., and can include 4 megabytes of memory for program storage and RS-232 circuitry for serial communications. By way of at least one serial interface 310, the selected track position indication can be transmitted to a local terminal 312 for display. The terminal 312 can be a VT-510 terminal by Digital Equipment Corp., Bedford, Mass., or can be a microprocessor-based computer or workstation. The terminal 312 also can be used to transmit commands to and effect calibration operations upon the phase processor via bus 214. The aforementioned functions that can be performed by the local terminal 312 also can be performed by a remote station 314 which may be a remote operations center.

The track position monitoring apparatus according to the invention herein can have an operational mode, a calibration mode, and a self-test mode. The apparatus can be operated, calibrated, and tested from the terminal 312 or the station 314. For example, the terminal 312 can be used to remotely determine calibration parameters for each of the phase processors connected thereto. Also, terminal 312 can perform remote diagnostic testing and performance monitoring of phase processors via the bus 214. Furthermore, the apparatus can be used to detect, and calibrate for, track position indication at distances greater than 1000 feet. Although the relationship between track impedance and shunt distance may not be substantially linear at distances greater than about 1000 feet, piece-wise linear relationships for distances lesser and greater than 1000 feet can be established during calibration, with calibration values relative to the predefined track shunt segments being stored in the memory 306 of the control processor 300. During operation, the control processor 300 can retrieve from memory 306 the particular calibration value that is associated with the respective track shunt segment, based upon its value, and compensate the track position indication accordingly.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the invention which is to be given the full breadth of the following claims and any and all embodiments thereof.

What is claimed is:

1. A car space measurement apparatus for tracking a rail vehicle position on a track, comprising:

a. a wayside sensor operably connected to said track for sensing a plurality of track parameters, said parameters being representative of said rail vehicle position; and b. a supervisory processor, connected to said wayside sensor, for receiving selected ones of said plurality of track parameters, determining said rail vehicle position therefrom, and asynchronously displaying a track position indication representative of said rail vehicle position;

wherein said selected ones are analog signals that are received from the track and are representative of track phase signals, and said supervisory processor further comprises an analog signal processor connected to said wayside sensor for receiving said analog signals.

2. The apparatus of claim 1 wherein said supervisory processor further comprises a phase processor connected to said analog signal processor, said phase processor for determining said rail vehicle position from said track phase signals and generating a track position indication therefrom.

3. The apparatus of claim 2 wherein said supervisory processor further comprises a control processor connected to said phase processor for selectively receiving and displaying said track position indication.

4. The apparatus of claim 3 further comprising a plurality of phase processors connected to said control processor, said control processor selectively receiving and displaying a respective track position indication.

5. The apparatus of claim 3 having an operational mode and a calibration mode and a self-test mode.

6. The apparatus of claim 5 wherein said calibration mode includes a piece-wise calibration of a track parameter.

7. The apparatus of claim 2 comprising a plurality of analog sensors connected to said phase processor, said phase processor for selectively determining a respective rail vehicle position from respective ones of said track phase signals and generating a respective track position indication therefrom.

8. The apparatus of claim 1 wherein said track phase signals include a compensated track impedance phase angle.

9. A car space measurement apparatus for tracking a rail vehicle position on a track, comprising:

a. a wayside sensor operably connected to said track for sensing a plurality of track parameters, said parameters being representative of said rail vehicle position;

b. a supervisory processor, connected to said wayside sensor, for receiving selected ones of said plurality of track parameters, determining said rail vehicle position therefrom, and asynchronously displaying a track position indication representative of said rail vehicle position;

wherein said selected ones are analog signals representative of track phase signals and said supervisory processor further comprises an analog signal processor connected to said wayside sensor for receiving said analog signals; and wherein said analog signal processor further comprises an analog signal converter for converting said analog signals into digital signals.

10. The apparatus of claim 9 wherein said analog signal processor further comprises a signal conditioner interposed between said wayside sensor and said converter, said conditioner including a filter having a preselected cutoff frequency.

11. The apparatus of claim 10 wherein said analog signal processor further comprises an opto-isolator connected between said converter and said supervisory processor, said optoisolator for reducing electromagnetic interference with said digital signals.

12. The apparatus of claim 10 wherein said filter is a high-pass filter, said cutoff frequency is about 30 Hz.

13. The apparatus of claim 9 wherein said phase processor includes a digital phase analyzer connected to said converter for receiving said digital signals and extracting a track position indication therefrom.

14. The apparatus of claim 13 wherein said supervisory processor further comprises a control processor for selectively receiving and displaying said track position indication, said selectively receiving being substantially asynchronous.

15. The apparatus of claim 14 having an operational mode and a calibration mode and a self-test mode.

16. The apparatus of claim 15 wherein said calibration mode includes a piece-wise calibration of a track parameter.

17. The apparatus of claim 13 wherein said phase processor further includes a track selector interposed between said digital phase analyzer and said analog signal processor for selectively receiving digital signals representative of said rail vehicle position from said track.

18. The apparatus of claim 17 wherein said supervisory processor further comprises a control processor for selectively receiving and displaying said track position indication, said selectively receiving being substantially asynchronous, and said control processor being connected to said phase processor.

19. The apparatus of claim 18 wherein said phase processor further comprises an asynchronous interface interposed between said digital phase analyzer and said control processor for asynchronously providing said track position indication from said phase processor to said control processor.

20. The apparatus of claim 19 wherein said asynchronous interface is an asynchronous computer bus interface.

21. The apparatus of claim 9 wherein each of said track phase signals has a variable phase delay responsive to said rail vehicle position on said track, said analog signal converter includes a serial digital pulse stream, said converter being responsive to said phase delay, and said serial digital pulse stream being representative of said phase delay.

22. A car space measurement apparatus for tracking a rail vehicle position on a track, comprising:

a. a wayside sensor operably connected to said track for sensing a plurality of track parameters, said parameters being representative of said rail vehicle position; and b. a supervisory processor, connected to said wayside sensor, for receiving selected ones of said plurality of track parameters, determining said rail vehicle position therefrom, and asynchronously displaying a track position indication representative of said rail vehicle position;

wherein said selected ones are analog signals that are received from the track and are representative of track phase signals, and said supervisory processor comprises:

a. an analog signal processor connected to said wayside sensor for receiving said analog signals;

b. a phase processor connected to said analog signal processor, said phase processor for determining said rail vehicle position from a plurality of said track phase signals and generating a track position indication therefrom; and c. a control processor for selectively receiving and displaying said track position indication, said selectively receiving being substantially asynchronous, and said control processor being connected to said phase processor.

23. A car space measurement apparatus for tracking a rail vehicle position on a track, comprising:

a. a wayside sensor operably connected to said track for sensing a plurality of track parameters said parameters being representative of said rail vehicle position;

b. a supervisory processor, connected to said wayside sensor, for receiving selected ones of said plurality of track parameters, determining said rail vehicle position therefrom, and asynchronously displaying a track position indication representative of said rail vehicle position;

wherein said selected ones are analog signals representative of track phase signals and wherein said supervisory processor comprises:

c. an analog signal processor connected to said wayside sensor for receiving said analog signals;

d. a phase processor connected to said analog signal processor, said phase processor for determining said rail vehicle position from a plurality of said track phase signals and generating a track position indication therefrom;

e. a control processor for selectively receiving and displaying said track position indication, said selectively receiving being substantially asynchronous, and said control processor being connected to said phase processor; and wherein said analog signal processor comprises:

f. a signal conditioner connected to said wayside sensor, said conditioner including a filter having a preselected cutoff frequency;

g. an analog signal converter for converting said analog signals into digital signals; and h. an opto-isolator connected between said converter and said supervisory processor, said opto-isolator for reducing electromagnetic interference with said digital signals.

24. The apparatus of claim 23 wherein said phase processor comprises:

i. a track selector connected to said analog signal processor for selectively receiving digital signals representative of said rail vehicle position on said track;

j. a digital phase analyzer connected to said track selector for extracting a track position indication from said digital signals; and k. an asynchronous interface connected to said digital phase analyzer for asynchronously providing said track position indication from said phase processor to said control processor.

25. The apparatus of claim 24 wherein said asynchronous interface is an asynchronous computer bus interface.

26. The apparatus of claim 23 wherein said filter is a high-pass filter, said cutoff frequency is about 30 Hz.

27. The apparatus of claim 23 wherein each of said track phase signals has a variable phase delay responsive to said rail vehicle position on said track, said analog signal converter includes a serial digital pulse stream, said converter being responsive to said phase delay, and said serial digital pulse stream being representative of said phase delay.

28. A car space measurement apparatus for tracking a rail vehicle position on a track, comprising:

a. a wayside sensor operably connected to said track for sensing a plurality of track parameters, said parameters being representative of said rail vehicle position;

b. a supervisory processor, connected to said wayside sensor, for receiving selected ones of said plurality of track parameters, determining said rail vehicle position therefrom, and asynchronously displaying a track position indication representative of said rail vehicle position;

wherein said selected ones are analog signals representative of track phase signals and wherein said supervisory processor comprises:

c. an analog signal processor connected to said wayside sensor for receiving said analog signals;

d. a phase processor connected to said analog signal processor, said phase processor for determining said rail vehicle position from a plurality of said track phase signals and generating a track position indication therefrom;

e. a control processor for selectively receiving and displaying said track position indication, said selectively receiving being substantially asynchronous, and said control processor being connected to said phase processor;

wherein said phase processor comprises:

f. a track selector connected to said analog signal processor for selectively receiving digital signals representative of said rail vehicle position on said track;

g. a digital phase analyzer connected to said track selector for receiving said digital signals and extracting a track position indication therefrom; and h. an asynchronous interface connected to said digital phase analyzer for asynchronously providing said track position indication from said phase processor to said control processor.

29. The apparatus of claim 28 wherein said asynchronous interface is an asynchronous computer bus interface.

30. A car space measurement apparatus for tracking a rail vehicle position on a track, comprising:

a. a wayside sensor operably connected to said track for sensing a plurality of track parameters, said parameters being representative of said rail vehicle position;

b. a supervisory processor, connected to said wayside sensor, for receiving selected ones of said plurality of track parameters, determining said rail vehicle position therefrom, and asynchronously displaying a track position indication representative of said rail vehicle position;

wherein said selected ones are analog signals representative of track phase signals and wherein said supervisory processor comprises:

c. a signal conditioner connected to said wayside sensor, said conditioner including a filter having a preselected cutoff frequency, said filter generally attenuating preselected frequencies in said analog signals;

d. an analog signal converter connected to said signal conditioner for converting said analog signals into digital signals;

e. an opto-isolator connected to said converter, said opto-isolator for reducing electromagnetic interference with said digital signals;

f. a track selector connected to said opto-isolator for selectively receiving digital signals representative of said rail vehicle position on said track;

g. a digital phase analyzer connected to said track selector for receiving said digital signals and extracting a track position indication therefrom;

h. a control processor operably connected to said digital phase analyzer, for selectively displaying said track position indication; and i. an asynchronous interface interposed between said digital phase analyzer and said control processor, said interface for asynchronously providing said track position indication from said phase processor to said control processor.

31. The apparatus of claim 30 wherein each of said track phase signals has a variable phase delay responsive to said rail vehicle position on said track, said analog signal converter includes a serial digital pulse stream, said converter being responsive to said phase delay, and said serial digital pulse stream being representative of said phase delay.

32. The apparatus of claim 30 wherein said asynchronous interface is an asynchronous computer bus interface.

33. The apparatus of claim 30 having an operational mode and a calibration mode and a self-test mode.

34. The apparatus of claim 33 wherein said calibration mode includes a piece-wise calibration of a track parameter.

35. The apparatus of claim 30 wherein said track phase signals include a compensated track impedance phase angle.

36. A car space measurement apparatus for tracking a rail vehicle position on a track, comprising a supervisory processor operably connected to said track, said supervisory processor receiving selected ones of a plurality of track parameters, said selected ones being representative of said rail vehicle position, said supervisory processor extracting a track position indication from said selected ones and asynchronously displaying said track position indication representative of said rail vehicle position;

wherein said selected ones are analog signals that are received from the track and are representative of track phase signals, and wherein said supervisory processor comprises:

a. an analog signal processor operably connected to said track for receiving said analog signals;

b. a phase processor connected to said analog signal processor, said phase processor for determining said rail vehicle position from a plurality of said track phase signals and generating a track position indication therefrom; and c. a control processor for selectively receiving and displaying said track position indication, said selectively receiving being substantially asynchronous, and said control processor being connected to said phase processor.

37. A car space measurement apparatus for tracking a rail vehicle position on a track, comprising a supervisory processor operably connected to said track, said supervisory processor receiving selected ones of a plurality of track parameters, said selected ones being representative of said rail vehicle position, said supervisory processor extracting a track position indication from said selected ones and asynchronously displaying said track position indication representative of said rail vehicle position;

wherein said selected ones are analog signals representative of track phase signals and wherein said supervisory processor comprises:

a. an analog signal processor operably connected to said track for receiving said analog signals;

b. a phase processor connected to said analog signal processor, said phase processor for determining said rail vehicle position from a plurality of said track phase signals and generating a track position indication therefrom;

c. a control processor for selectively receiving and displaying said track position indication, said selectively receiving being substantially asynchronous, and said control processor being connected to said phase processor;

wherein said analog signal processor comprises:

d. a signal conditioner operably connected to said track, said conditioner including a filter having a preselected cutoff frequency;

e. an analog signal converter for converting said analog signals into digital signals; and f. an opto-isolator connected between said converter and said supervisory processor, said opto-isolator for reducing electromagnetic interference with said digital signals.

38. The apparatus of claim 37 wherein said phase processor comprises:

g. a track selector connected to said analog signal processor for selectively receiving digital signals representative of said rail vehicle position on said track;

h. a digital phase analyzer connected to said track selector for receiving said digital signals and extracting a track position indication therefrom; and i. an asynchronous interface connected to said digital phase analyzer for asynchronously providing said track position indication from said phase processor to said control processor.

39. The apparatus of claim 38 wherein said asynchronous interface is an asynchronous computer bus interface.

40. The apparatus of claim 37 wherein said filter is a high-pass filter, said cutoff frequency is about 30 Hz.

41. The apparatus of claim 37 wherein each of said track phase signals has a variable phase delay responsive to said rail vehicle position on said track, said analog signal converter includes a serial digital pulse stream, said converter being responsive to said phase delay, and said serial digital pulse stream being representative of said phase delay.

42. A car space measurement apparatus for tracking a rail vehicle position on a track, comprising a supervisory processor operably connected to said track, said supervisory processor receiving selected ones of a plurality of track parameters, said selected ones being representative of said rail vehicle position, said supervisory processor extracting a track position indication from said selected ones and asynchronously displaying said track position indication representative of said rail vehicle position;

wherein said selected ones are analog signals representative of track phase signals and wherein said supervisory processor comprises:

a. an analog signal processor operably connected to said track for receiving said analog signals;

b. a phase processor connected to said analog signal processor, said phase processor for determining said rail vehicle position from a plurality of said track phase signals and generating a track position indication therefrom;

c. a control processor for selectively receiving and displaying said track position indication, said selectively receiving being substantially asynchronous, and said control processor being connected to said phase processor;

wherein said phase processor comprises:

d. a track selector connected to said analog signal processor for selectively receiving digital signals representative of said rail vehicle position on said track;

e. a digital phase analyzer connected to said track selector for receiving said digital signals and extracting a track position indication therefrom; and f. an asynchronous interface connected to said digital phase analyzer for asynchronously providing said track position indication from said phase processor to said control processor.

43. The apparatus of claim 42 wherein said asynchronous interface is an asynchronous computer bus interface.

44. A car space measurement apparatus for tracking a rail vehicle position on a track, comprising a supervisory processor operably connected to said track, said supervisory processor receiving selected ones of a plurality of track parameters said selected ones being representative of said rail vehicle position, said supervisory processor extracting a track position indication from said selected ones and asynchronously displaying said track position indication representative of said rail vehicle position;

wherein said selected ones are analog signals representative of track phase signals;

wherein said supervisor processor comprises:

a. an analog signal processor operably connected to said track for receiving said analog signals;

b. a phase processor connected to said analog signal processor, said phase processor for determining said rail vehicle position from a plurality of said track phase signals and generating a track position indication therefrom;

c. a control processor for selectively receiving and displaying said track position indication, said selectively receiving being substantially asynchronous, and said control processor being connected to said phase processor; and wherein said track phase signals include a compensated track impedance phase angle.

* * * * *